US010847924B2

(12) United States Patent
Nguyen Nhu et al.

(10) Patent No.: US 10,847,924 B2
(45) Date of Patent: Nov. 24, 2020

(54) CONTACT DEVICE AND CONTACT SYSTEM

(71) Applicant: TE Connectivity Germany GmbH, Bensheim (DE)

(72) Inventors: Lam Nguyen Nhu, Bensheim-Auerbach (DE); Olivier De Cloet, Lorsch (DE); Christian Schrettlinger, Bensheim (DE); Wolfgang Mueller, Darmstadt (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 16/445,873

(22) Filed: Jun. 19, 2019

(65) Prior Publication Data

US 2019/0305469 A1 Oct. 3, 2019

Related U.S. Application Data

(63) Continuation of application No. PCT/EP2017/083746, filed on Dec. 20, 2017.

(30) Foreign Application Priority Data

Dec. 20, 2016 (DE) ..... 10 2016 125 029

(51) Int. Cl.
*H01R 13/52* (2006.01)
*H01R 13/436* (2006.01)
(Continued)

(52) U.S. Cl.
CPC ..... *H01R 13/521* (2013.01); *H01R 13/4361* (2013.01); *H01R 13/5025* (2013.01);
(Continued)

(58) Field of Classification Search
CPC ..... H01R 13/521; H01R 13/4361; H01R 13/5025
(Continued)

(56) References Cited

U.S. PATENT DOCUMENTS 5,222,909 A 6/1993 Nomura et al.
5,490,785 A * 2/1996 Hein ..... H01R 13/5221 439/587
(Continued)

FOREIGN PATENT DOCUMENTS

CN 1211836 C 7/2005
CN 101330175 A 12/2008
(Continued)

OTHER PUBLICATIONS

PCT Notification of Transmittal, The International Search Report and The Written Opinion of the International Searching Authority, International Application No. PCT/EP2017/083746, dated Mar. 27, 2018, 14 pages.
(Continued)

*Primary Examiner* — Alexander Gilman
(74) *Attorney, Agent, or Firm* — Barley Snyder

(57) ABSTRACT

A contact device comprises an outer housing delimiting a first inner space, an inner housing delimiting a second inner space and arranged in the first inner space, a contact element arranged in the second inner space, a first sealing element arranged between the inner housing and the outer housing, and a second sealing element arranged between the contact element and the inner housing. The first sealing element seals the first inner space from an environment of the contact device. The second sealing device seals the second inner space from the environment.

33 Claims, 8 Drawing Sheets

(51) Int. Cl.
*H01R 13/502* (2006.01)
*H01R 107/00* (2006.01)

(52) U.S. Cl.
CPC ..... *H01R 13/5202* (2013.01); *H01R 13/502* (2013.01); *H01R 2107/00* (2013.01)

(58) Field of Classification Search
USPC ..... 439/587
See application file for complete search history.

(56) References Cited

U.S. PATENT DOCUMENTS 5,997,349 A * 12/1999 Yoshioka ..... H01R 9/038 439/579
6,811,817 B2 11/2004 Sugeta et al.
7,029,327 B2 * 4/2006 Devine ..... H01R 13/521 439/587
7,059,902 B2 * 6/2006 Nakamura ..... H01R 13/641 439/489
7,229,303 B2 * 6/2007 Vermoesen ..... H01R 13/20 439/271
7,481,675 B2 * 1/2009 Patterson ..... H01R 13/5205 439/148
7,695,301 B2 * 4/2010 Mudge, III ..... H01R 13/533 439/271
8,133,076 B2 3/2012 Nakamura
8,235,752 B2 8/2012 Nakamura
8,277,250 B2 * 10/2012 Suzuki ..... H01R 13/504 439/604
8,608,508 B2 * 12/2013 Kataoka ..... H01R 13/5208 439/275
8,845,361 B2 * 9/2014 Magno, Jr. ..... H02G 15/013 439/587
8,851,925 B2 * 10/2014 Kataoka ..... H01R 43/24 439/604
8,939,799 B2 * 1/2015 Watanabe ..... H01R 13/627 439/686
9,231,337 B2 1/2016 Sakakura
9,385,516 B2 * 7/2016 Tanaka ..... H02G 3/22
9,543,702 B2 * 1/2017 Horiuchi ..... H01R 13/641
9,865,964 B2 * 1/2018 Hashimoto ..... H01R 13/5208
9,929,506 B2 * 3/2018 Hashimoto ..... H01R 13/6272
9,948,025 B2 * 4/2018 Hashimoto ..... H01R 13/432
2005/0118850 A1 * 6/2005 Ito ..... H01R 13/5208 439/275
2005/0176298 A1 * 8/2005 Flowers ..... H01R 13/4365 439/595
2007/0059970 A1 * 3/2007 Ichio ..... H01R 13/6272 439/382
2009/0247000 A1 * 10/2009 Shuey ..... H01R 13/4365 439/358
2011/0045696 A1 * 2/2011 Nakamura ..... H01R 13/516 439/587
2011/0143566 A1 * 6/2011 Nakamura ..... H01R 13/5205 439/271
2013/0333944 A1 * 12/2013 Sakakura ..... H01R 13/5804 174/74 R
2014/0011400 A1 1/2014 Shiga
2015/0144395 A1 5/2015 Tanaka
2015/0333430 A1 * 11/2015 Hashimoto ..... H01R 13/4223 439/752

FOREIGN PATENT DOCUMENTS

CN 101997228 A 3/2011
CN 102157843 A 8/2011
CN 103515774 A 1/2014
CN 104145379 A 11/2014
CN 103515775 A 1/2016
EP 0903814 A1 3/1999
EP 0996199 A2 4/2000
JP 2000091023 A 3/2000
JP 2013048019 A 3/2013
JP 2013258117 A 12/2013
JP 201417119 A 1/2014

OTHER PUBLICATIONS

Chinese First Office Action and English translation, dated Apr. 29, 2020, 18 pages.
Indian Patent Office Examination Report, dated Aug. 31, 2020, 5 pages.
Abstract of JP 2013048019, dated Mar. 7, 2013, 1 page.
Japanese Notice of Reasons for Refusal and English translation, dated Aug. 18, 2020, 10 pages.
Abstract of JP2013258117, dated Dec. 26, 2013, 1 page.

* cited by examiner

CONTACT DEVICE AND CONTACT SYSTEM

CROSS-REFERENCE TO RELATED APPLICATIONS

This application is a continuation of PCT International Application No. PCT/EP2017/083746, filed on Dec. 20, 2017, which claims priority under 35 U.S.C. § 119 to German Patent Application No. 102016125029.5, filed on Dec. 20, 2016.

FIELD OF THE INVENTION

The present invention relates to a contact device and, more particularly, to a contact device sealed from an environment.

BACKGROUND

Many different configurations of contact systems with contact devices have an inner space of the contact device sealed from the environment of the contact system.

SUMMARY

A contact device comprises an outer housing delimiting a first inner space, an inner housing delimiting a second inner space and arranged in the first inner space, a contact element arranged in the second inner space, a first sealing element arranged between the inner housing and the outer housing, and a second sealing element arranged between the contact element and the inner housing. The first sealing element seals the first inner space from an environment of the contact device. The second sealing device seals the second inner space from the environment.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
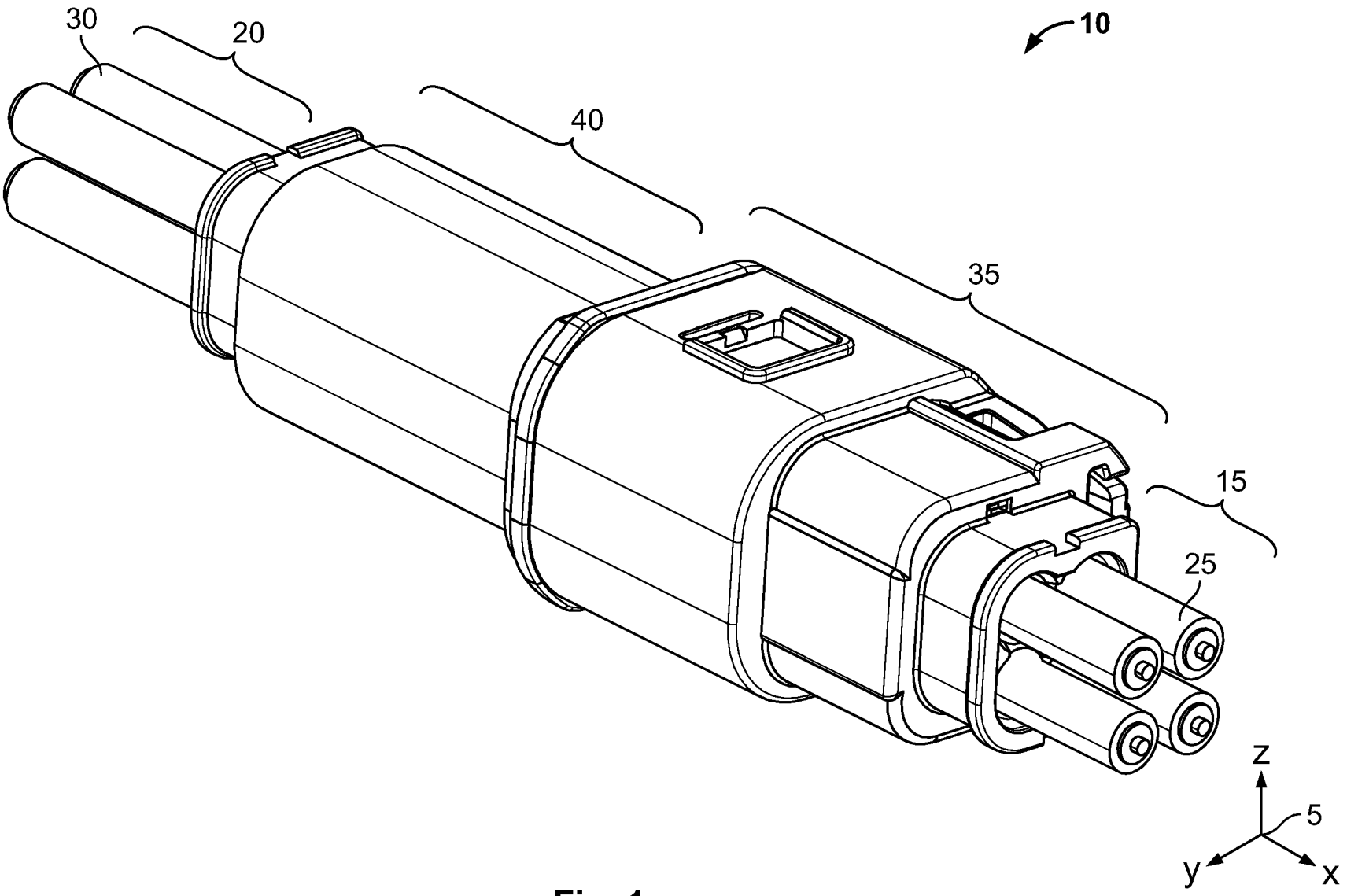
FIG. 1 is a perspective view of a contact system.

Exemplary embodiments of the present invention will be described hereinafter in detail with reference to the attached drawings, wherein like reference numerals refer to like elements. The present invention may, however, be embodied in many different forms and should not be construed as being limited to the embodiments set forth herein. Rather, these embodiments are provided so that the present disclosure will convey the concept of the disclosure to those skilled in the art.

In the following figures, a coordinate system 5 is referred to. The coordinate system 5 is formed by way of example as a right-handed trihedron and has an x-axis, a y-axis, and a z-axis. The x-axis extends in the longitudinal direction. The y-axis extends in the transverse direction and the z-axis in the vertical direction. Of course, the coordinate system 5 can also be formed differently.

A contact system 10 according to an embodiment, shown in FIG. 1, is formed to provide an electrical connection between a first electrical conductor 15 and a second electrical conductor 20.

The first electrical conductor 15 and the second electrical conductor 20 have a plurality of conductor strands 25, 30 in the embodiment shown in FIG. 1. In the embodiment, each of the conductor strands 25, 30 is formed as a coaxial conductor with a first electrical conductor and a second electrical conductor which is arranged coaxially to the first electrical conductor. In an embodiment, each electrical conductor 15, 20 has four conductor strands 25, 30. In other embodiments, a different number of conductor strands 25, 30 can also be provided which are electrically connected to each other by the contact system 10. The conductor strand 25, 30 can also be formed differently and comprise only one electrical conductor, for example.

The contact system 10, as shown in FIG. 1, has a first contact device 35 and a second contact device 40. The first contact device 35 is connected to the first electrical conductor 15. The second contact device 40 is connected to the second electrical conductor 20.

Figure 2:
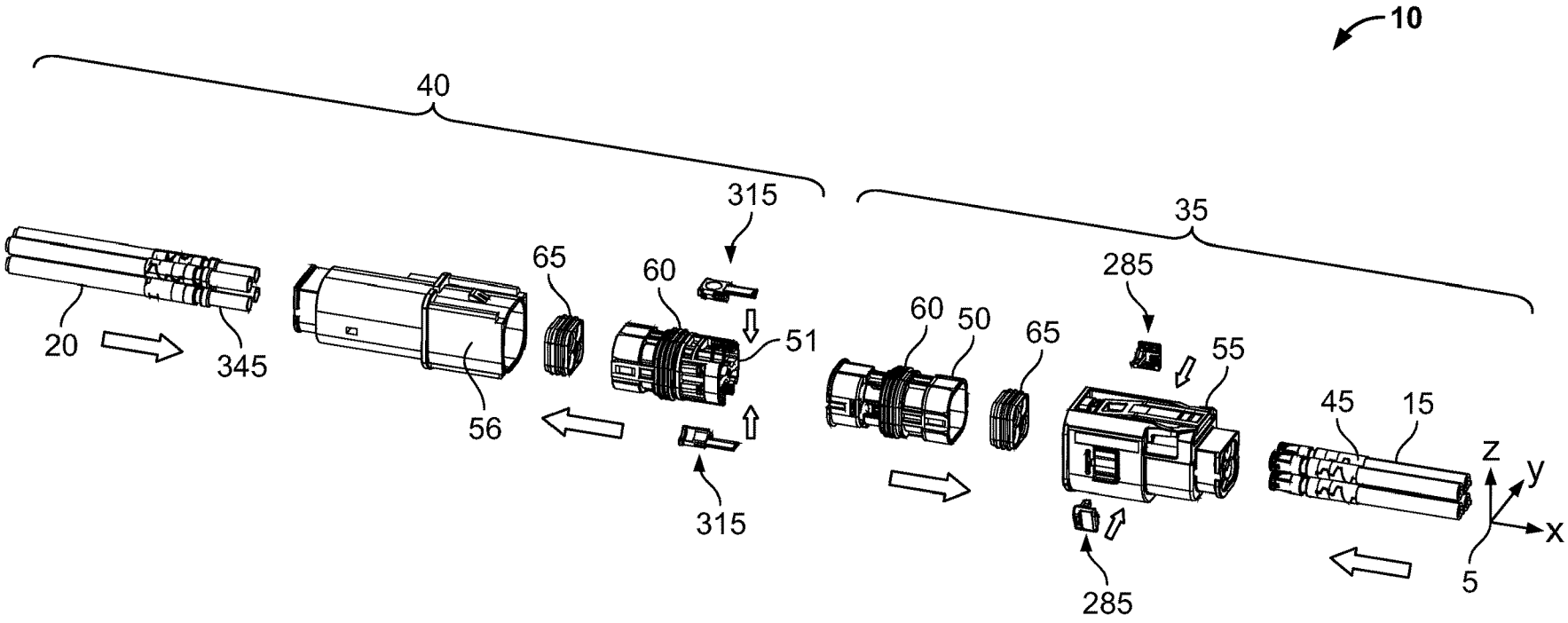
FIG. 2 is an exploded perspective view of the contact system.

As shown in FIG. 2, the first contact device 35 has at least a first contact element 45, an inner housing 50, an outer housing 55, a first sealing element 60, and a second sealing element 65. In the shown embodiment, the first contact device 35 has a first contact securing device 285.

Figure 7:
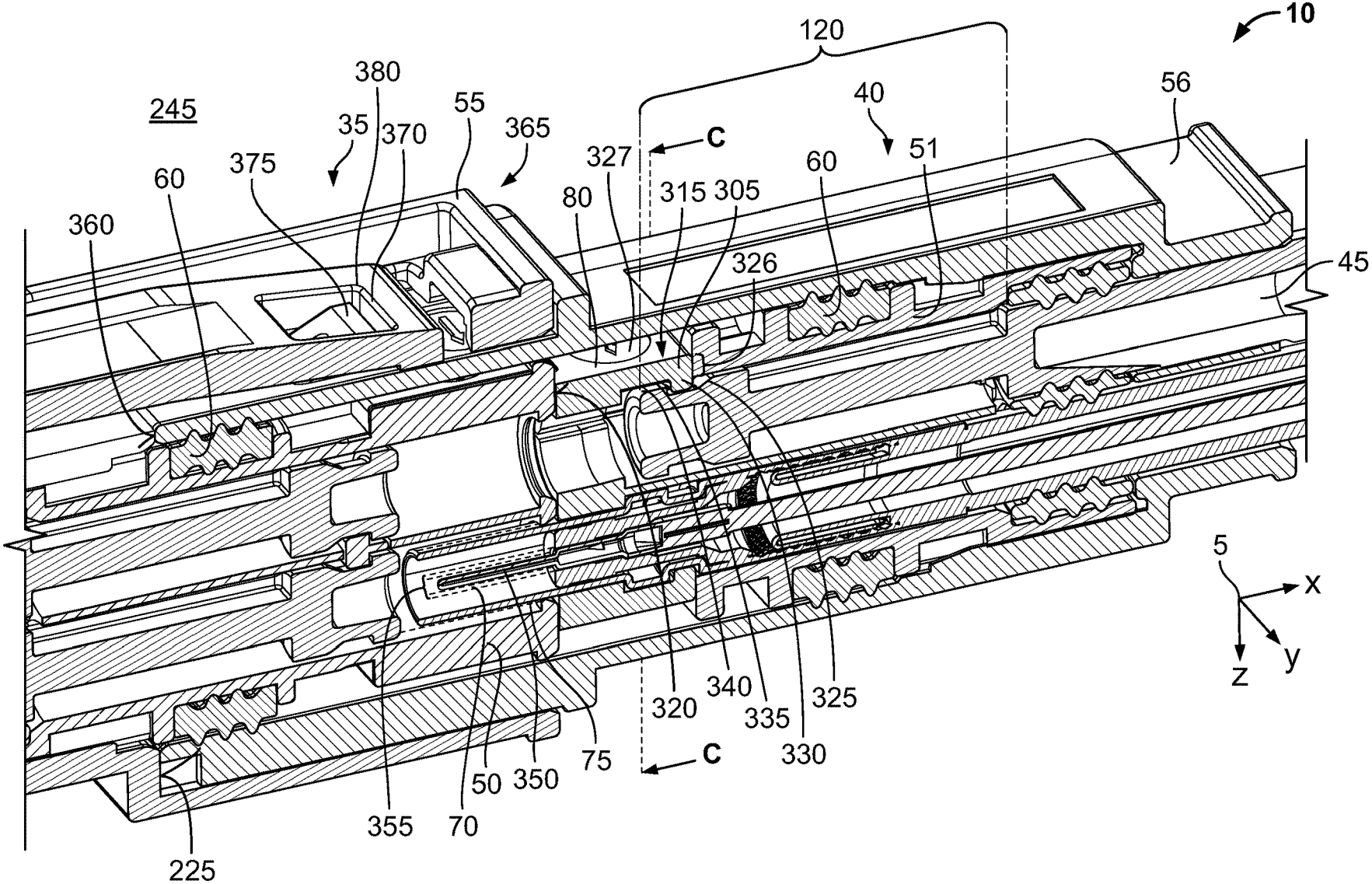
FIG. 7 is a sectional perspective view of a second portion of the contact system.
Figure 8:
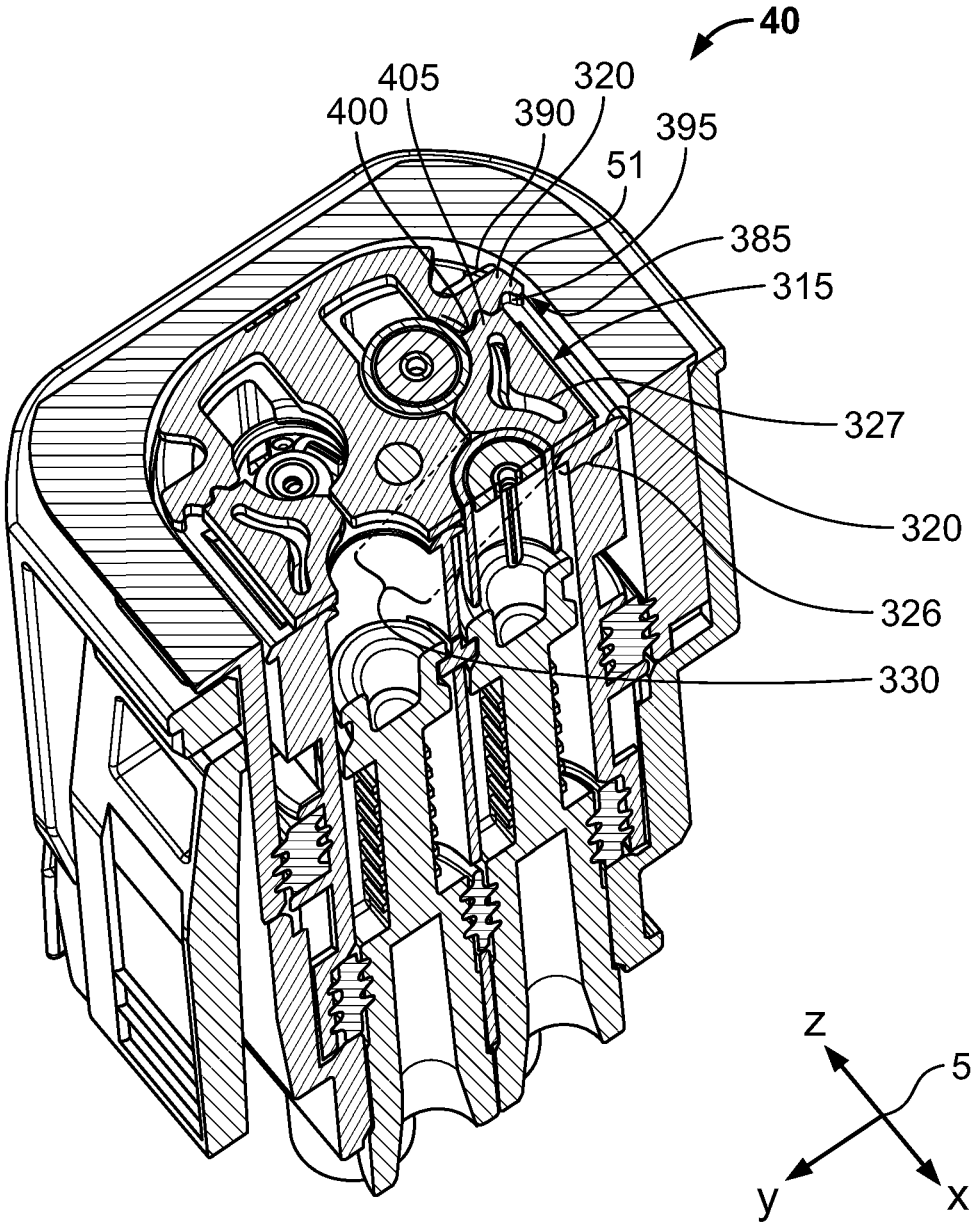
FIG. 8 is a sectional perspective view of the second portion of the contact system, taken along plane C-C of FIG. 7.

The second contact device 40, apart from small deviations which are referred to in FIGS. 7 and 8, is formed in its constructional features substantially identically to the first contact device 35 and has a second contact element 345, an inner housing 51, an outer housing 56, the first sealing element 60, and the second sealing element 65. Furthermore, the second contact device 40 has a second contact securing device 315 in the shown embodiment. The geometric configurations of the second contact device 40 and the first contact device 35 are coordinated.

Figure 3:
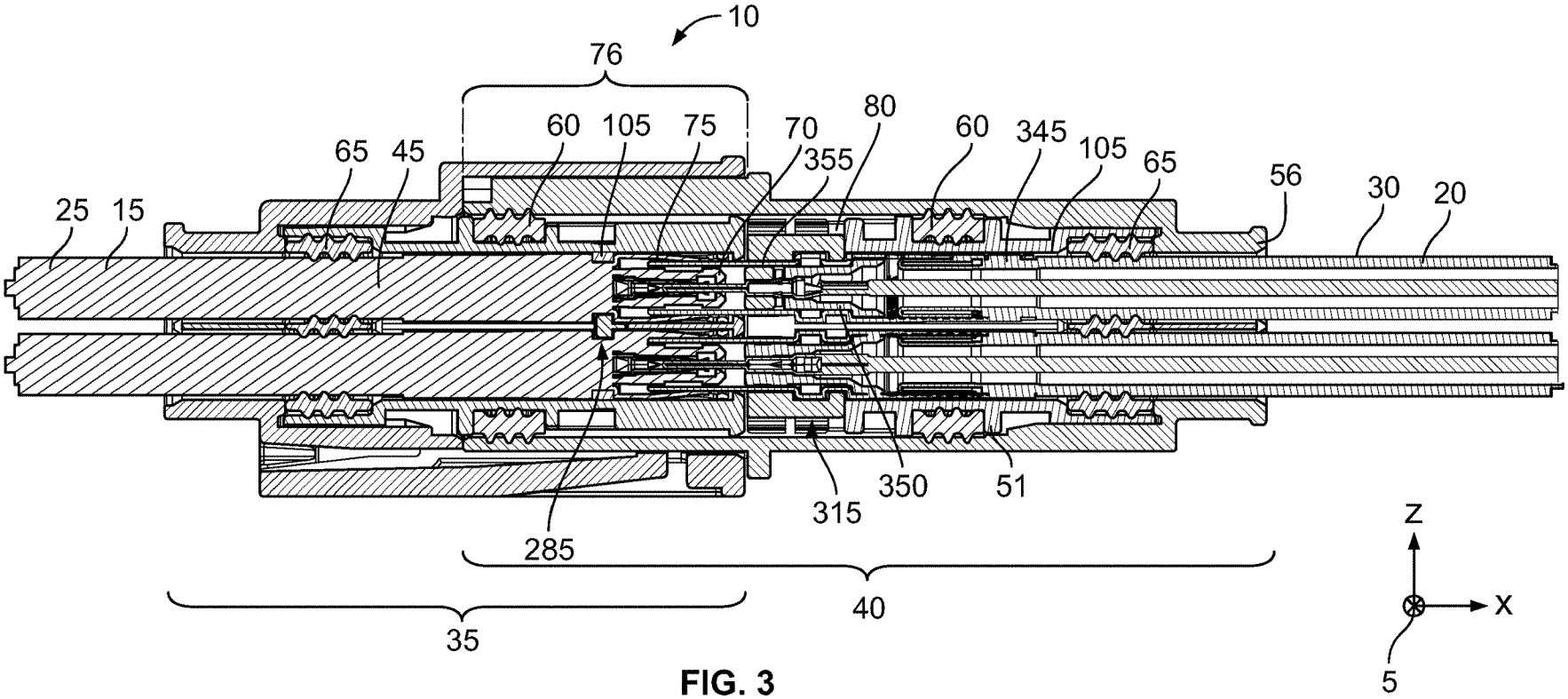
FIG. 3 is a sectional side view of the contact system.

In the contact system 10, as shown in FIG. 3, the first contact element 45 is formed as a first coaxial contact element and has a first plug contact 70 and a first bushing contact 75 in an embodiment. In this case, the first plug contact 70 is arranged coaxially to the first bushing contact 75. Of course, it is also conceivable that the first contact element 45 is also formed differently.

In the embodiment shown in FIG. 3, a first contact element 45 is provided for each first conductor strand 25, the first contact element 45 being electrically connected to the first conductor strand 25. Correspondingly, four first contact elements 45 are provided respectively in the embodiment by way of example, which, at equal intervals, are offset relative to each other in the transverse direction and are arranged spaced apart from each other in the vertical direction. In this embodiment, two first contact elements 45 are arranged respectively in a common xy-plane. Of course, it is also conceivable that the first contact elements 45 are also arranged in a common plane.

As shown in FIG. 3, the second contact device 40 has a second contact element 345 for every second conductor strand 30, instead of the first contact element 45. The second contact element 345 is formed similarly to the first contact element 45. The second contact element 345 has a second bushing contact 350 and a second plug contact 355. The second bushing contact 350 is arranged coaxially to the second plug contact 355. The second bushing contact 350 and the first plug contact 70 engage each other. The second plug contact 355 engages in the first bushing contact 75. As a result, a reliable electrical connection between the first contact element 45 and the second contact element 345 is guaranteed.

In the assembled state, the outer housing 56 of the second contact device 40 engages in the outer housing 55 of the first contact device 35. In this case, the outer housing 56 of the second contact device 40 is arranged on the outside between the outer housing 55 of the first contact device 35 and the first sealing element 60.

The outer housing 56 of the second contact device 40 has a housing engaging section 76, as shown in FIG. 3. The housing engaging section 76 engages in the outer housing 50 of the first contact device 35. The outer housings 55, 56 delimit a first inner space 80. The inner housings 50, 51 are arranged in the first inner space 80. The inner housings 50, 51 delimit a second inner space 105.

Figure 4:
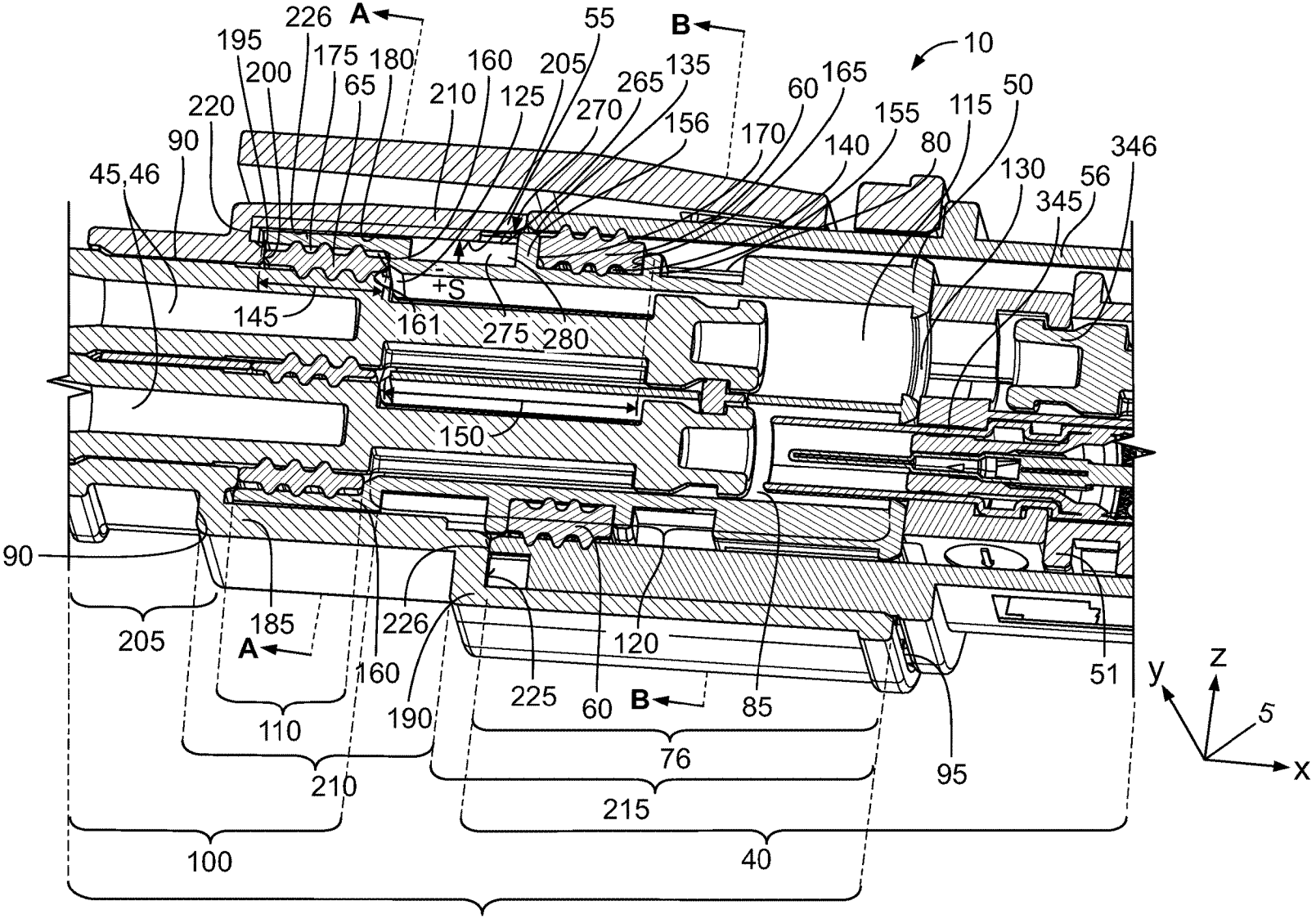
FIG. 4 is a sectional side view of a first portion of the contact system.

As shown in FIGS. 3 and 4, the first sealing element 60 of the first contact device 35 is arranged between the inner housing 50 of the first contact device 35 and the outer housing 56 of the second contact device 40, and seals off the first inner space 80 from an environment 245. The first sealing element 60 of the second contact device 40 is arranged between the inner housing 51 of the second contact device 40 and the outer housing 56 of the second contact device 40, and seals off the first inner space 80 from the environment 245. The second sealing elements 65 of the two contact devices 35, 40 reliably seal off the second inner space 105 at the respective contact element 45, 345 and the inner housings 50, 51 from the environment 245.

A sealing plug 46, 346 is shown in FIG. 4 partially instead of the contact element 45, 345. The sealing plug 46, 346 and the contact element 45, 345 have a substantially identical outer geometry. The features described hereinafter for the contact element 45, 345 also apply to the sealing plugs 46, 346, with the exception that the sealing plugs 46, 346 do not provide an electrical connection and do not engage each other. The sealing plugs 46, 346 close off the contact device 35, 40 from the environment 245 and seal off the second inner space 105 from the environment 245. The sealing plug 46, 346 has a plastic as its material.

The outer housing 55 of the first contact device 35, in an embodiment, has a substantially rectangular cross-section. Furthermore, the outer housing 55 of the first contact device 35 has a first opening 90 at a first longitudinal end and a second opening 95 at a second longitudinal end, as shown in FIG. 4. The first opening 90 is formed corresponding to an outside, geometric configuration of a connection section 100 of the contact element 45, 345. The connection section 100 is connected to the associated electrical conductor 15, 20 at one side and connected to a securing section 120 of the contact element 45, 345 at the other side. The securing section 120 is arranged on the outside of the contact element 45, 345. Furthermore, the connection section 100 engages through the first opening 90. The second opening 95 is arranged in the longitudinal direction opposite the first opening 90. In the second opening 95 of the outer housing 55 of the first contact device 35, the outer housing 56 engages in the second contact device 40.

The second inner space 105, as shown in FIG. 4, has a first inner space section 110 and at least one second inner space section 115. The second inner space section 115 is formed in a chamber-like manner. The securing section 120 of the contact element 45, 345 is arranged in the second inner space section 115. In an embodiment, the second inner space section 115 is cylindrically formed. The second inner space section 115 opens out at a side which faces the first opening 90 at a third opening 125 of the inner housing 50 in the first inner space section 110. The first contact element 45 engages through the third opening 125.

The first inner space section 110 is formed wider than the second inner space section 115 in the transverse direction, such that at the first inner space section 110 a plurality of second inner space sections 115 can open out at a longitudinal side of the first inner space section 110. The inner housing 50 of the first contact device 35 has a fourth opening 130 in the longitudinal direction on the side which is opposite the first inner space section 110, at which fourth opening 130 the second inner space section 115 similarly opens out. The second contact element 345 engages through the fourth opening 130.

As shown in FIG. 4, the inner housing 50 of the first contact device 35 has a first sealing receptacle 140 at a first outer peripheral surface 135. The first sealing receptacle 140 is open outwardly towards the outer housings 55, 56 of the contact devices 35, 40 and has a rectangular cross-section in the longitudinal section. The first sealing receptacle 140 is arranged circumferentially around the inner housing 50. The first sealing element 60 is arranged in the first sealing receptacle 140. The outer housing 56 of the second contact device 40 is arranged on the outside in the longitudinal direction at the level of the first sealing element 60 and the outer housing 55 of the first contact device 35 is arranged on the outside of the outer housing 56 of the second contact device 40.

The inner housing 50 of the first contact device 35, as shown in FIG. 4, has a first housing section 145, a second housing section 150, a first web 155, and a second web 156.

As shown in FIG. 4, the first housing section 145 and the second housing section 150 extend in the longitudinal direction. The first housing section 145 abuts against the second housing section 150 in the longitudinal direction. The first housing section 145 is formed wider than the second housing section 150 in the transverse direction. In this case, a first shoulder 160 with a shoulder surface 161 is arranged at a transition between the first housing section 145 and the second housing section 150. The shoulder surface 161 extends in a yz-plane in an embodiment.

The first web 155 and the second web 156 are arranged offset relative to the first shoulder 160 and relative to the first housing section 145 in the longitudinal direction. In the embodiment shown in FIG. 4, the second web 156 is arranged on the outside of the second housing section 150 between the first shoulder 160 and the first web 155. The first web 155 is arranged on the outside of the second housing section 150.

In the embodiment shown in FIG. 4, the first web 155 and the second web 156 are arranged circumferentially at the first outer peripheral surface 135 of the inner housing 50 of the first contact device 35. In embodiments, the first web 155 and/or the second web 156 can also have interruptions. In an embodiment, the first web 155 is formed shorter than the second web 156 in the transverse direction. In other embodiments, the first web 155 can also be formed wider than or be the same width as the second web 156.

As shown in FIG. 4, the first web 155 delimits the first sealing receptacle 140 at a first longitudinal end with a first side surface 165, and the second web 156 delimits the first sealing receptacle 140 at a second longitudinal end with a second side surface 170. The first side surface 165 and the second side surface 170 are arranged parallel to each other in the embodiment and are perpendicular to the first outer peripheral surface 135 in the first sealing receptacle 140. Furthermore, the first and the second side surfaces 165, 170 each extend in a yz-plane. The first sealing receptacle 140 is delimited by the first outer peripheral surface 135 of the second housing section 150 in the transverse direction and vertical direction. On the outside, the first sealing receptacle 140 is delimited by the outer housing 56 of the second contact device 40.

The contact device 35, 40 further has a second sealing receptacle 175 as shown in FIG. 4. The second sealing element 65 is arranged in the second sealing receptacle 175. The second sealing receptacle 175 is delimited on the outside by a first inner peripheral surface 180 of the first housing section 145. A first longitudinal end of the second sealing receptacle 175 is delimited by the first shoulder 160.

The outer housing 55 of the first contact device 35 is formed in a tiered manner and has a second shoulder 185 and a third shoulder 190. The outer housing 55 has a first outer housing section 205, a second outer housing section 210, and a third outer housing section 215. The second shoulder 185 is arranged between the first outer housing section 205 and the second outer housing section 210. The third shoulder 190 is arranged between the second outer housing section 210 and the third outer housing section 215. The first outer housing section 205 has a smaller transverse extension than the second outer housing section 210. The second outer housing section 210 has a shorter transverse extension than the third outer housing section 215.

The third shoulder 190 is arranged offset relative to the second shoulder 185 in the longitudinal direction, as shown in FIG. 4. The second shoulder 185 abuts against the first opening 90 of the outer housing 55 of the first contact device 35. A protrusion 195 is provided at the second shoulder 185 on a longitudinal side which faces the second sealing receptacle 175. A third side surface 200 is arranged at the protrusion 195. The protrusion 195 is arranged in the transverse direction at the level of the first shoulder 160 of the inner housing 50 of the first contact device 35. The third side surface 200 is aligned parallel to the shoulder surface 161 in an embodiment. The third side surface 200 delimits a second longitudinal end of the second sealing receptacle 175.

A receptacle 220 is provided between the protrusion 195 and the second outer housing section 210 at the second shoulder 185, as shown in FIG. 4. The receptacle 220 is delimited on the outside by a second inner peripheral surface 206 of the second outer housing section 210 and on the inside by the protrusion 195. The receptacle 220 is delimited by the second shoulder 185 in the longitudinal direction. In the assembled state of the first contact device 35, an end face of the first housing section 145 of the inner housing 50 of the first contact device 35 on a side which faces away from the first outer housing section 205 engages in the receptacle 220.

The third shoulder 190 is arranged between the first sealing element 60 and the second sealing element 65 in the longitudinal direction. The third shoulder 190 is substantially arranged by way of example at the level of the second web 156 in the longitudinal direction. In this case, the third shoulder 190 has a stop surface 225. The stop surface 225 is arranged on a longitudinal side, which faces the first sealing element 60, of the third shoulder 190. An end face 226 of the outer housing 56 of the second contact device 40 rests against the stop surface 225 of the first contact device 35.

In order to guarantee an axial position of the inner housing 50 of the first contact device 35 relative to the outer housing 55 of the first contact device 35 in the inserted state, the outer housing 55 of the first contact device 35 can additionally comprise a first bearing surface 265 and the inner housing 50 can comprise a second bearing surface 270 and a tensioning device 275, as shown in FIG. 4. The first bearing surface 265 and the second bearing surface 270 are, in this case, aligned conically and/or running obliquely towards the x-axis. In this case, a low inclination by a few degrees is enough for the bearing surface 265, 270 relative to the x-axis. In the embodiment, the bearing surface 265, 270 is arranged between the first sealing element 60 and the second sealing element 65 in the longitudinal direction. To form the tensioning device 275, the inner housing 50 has a thickening 280 on the outside of the second housing section 150. The thickening 280 is, in this case, arranged between the second web 156 and the first shoulder 160 in the longitudinal direction. The thickening 280 connects the second web 156 to the first shoulder 160 by way of example. The second bearing surface 270 is arranged on the outside of the tensioning device 275.

Upon insertion of the inner housing 50 of the first contact device 35 into the outer housing 55 of the first contact device 35, the tensioning device 275 is elastically tensioned in the transverse direction by the oblique alignment of the bearing surface 265, 270. In the end position, the tensioning device 275 presses the second bearing surface 270 in the transverse direction outwardly onto the first bearing surface 265 with a pretensioning force FS and thus ensures an unwanted withdrawal, for example in the event of the contact system 10, the inner housing 50 of the first contact device 35 being released from the outer housing 55 of the first contact device 35. Furthermore, a quick assembly option of the first contact device 35 is guaranteed by the tensioning device 275. The arrangement of the tensioning device 275 and the bearing surface 265, 270 in the longitudinal direction between the first sealing element 60 and the second sealing element 65 guarantees that the second sealing element 65 can reliably seal off the second inner space 105 and the first sealing element 60 can reliably seal off the first inner space 80 from the environment 245.

Figure 5:
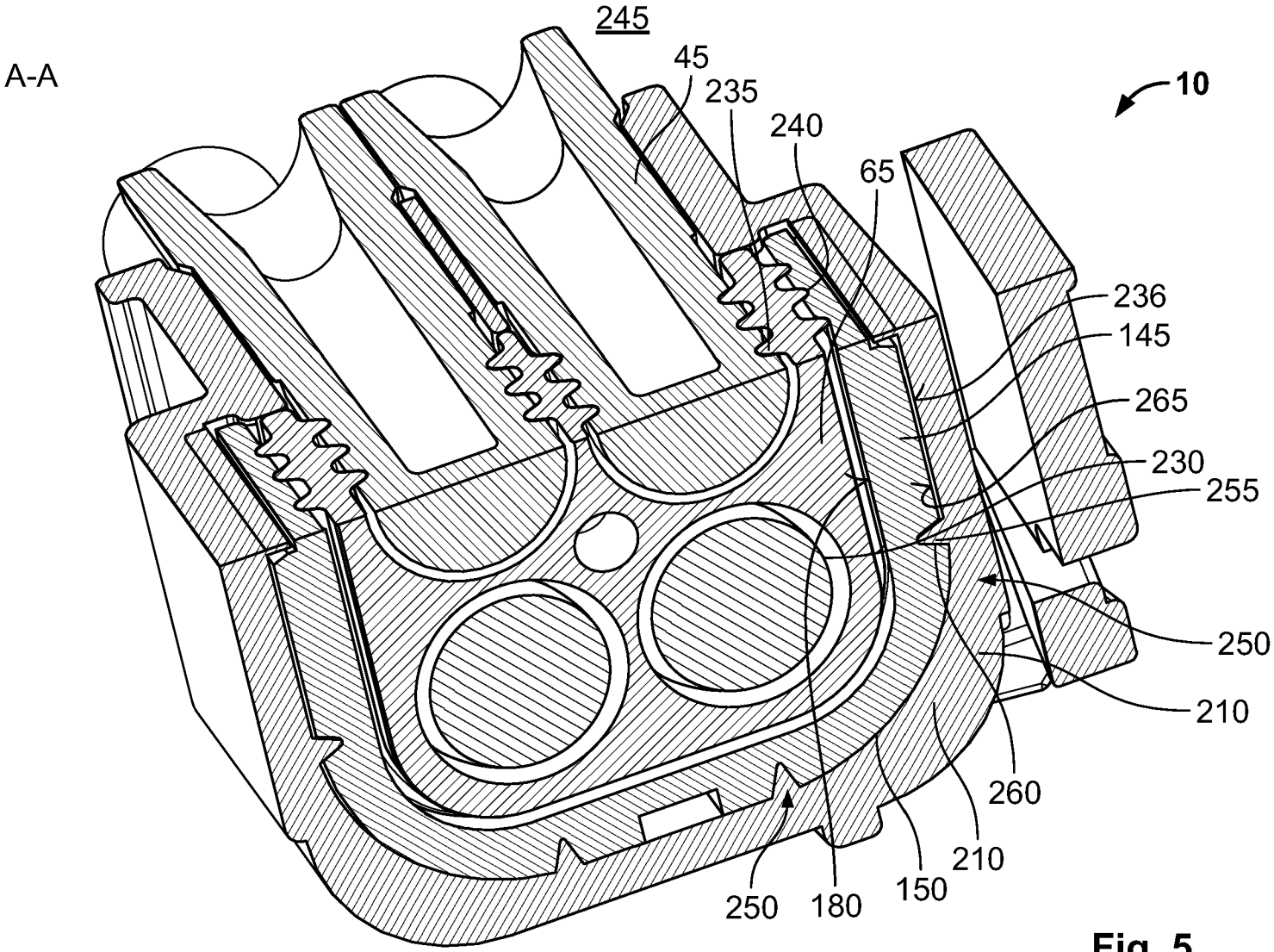
FIG. 5 is a sectional perspective view of the first portion of the contact system, taken along plane A-A of FIG. 4.

In an embodiment, the sealing element 60, 65 is made from an elastomer. The second sealing element 65, as shown in FIG. 5, has a notch 230 for each contact element 45, 345 respectively. The notch 230 is selected corresponding to the geometric configuration of the connection section 100, which is guided through the notch 230.

The first sealing element 60 can have at least one first sealing lip 235 in the notch 230 in order to achieve a reliable seal at the contact element 45, 345 of the second inner space 105. At least one second sealing lip 240 is also provided at a second outer peripheral surface 236 of the second sealing element 65, as shown in FIG. 5. The second sealing lips 240 rest on the first inner peripheral surface 180 in the second sealing receptacle 175. As a result, the second inner space 105 is reliably sealed off from the environment 245 of the contact system 10.

The first contact device 35 has a guide device 250, shown in FIG. 5. The guide device 250 has a guide rail 255 extending in the longitudinal direction and a guide receptacle 260 extending in the longitudinal direction. The guide rail 255 and the guide receptacle 260 engage each other. The guide receptacle 260 is arranged on the outside, for example, of the second housing section 150. The guide rail 255 is arranged on the inside of the second outer housing section 210. The guide device 250 ensures that upon insertion of the inner housing 50 of the first contact device 35 into the outer housing 55 of the first contact device 35, the inner housing 50 of the first contact device 35 is not canted and can be inserted as far as its end position, which is fixed by engaging the first housing section 145 in the receptacle 220. Of course, the guide receptacle 260 can also be arranged on the inside of the outer housing 55 of the first contact device 35 and the guide rail 255 on the outside of the inner housing 50 of the first contact device 35.

Figure 6:
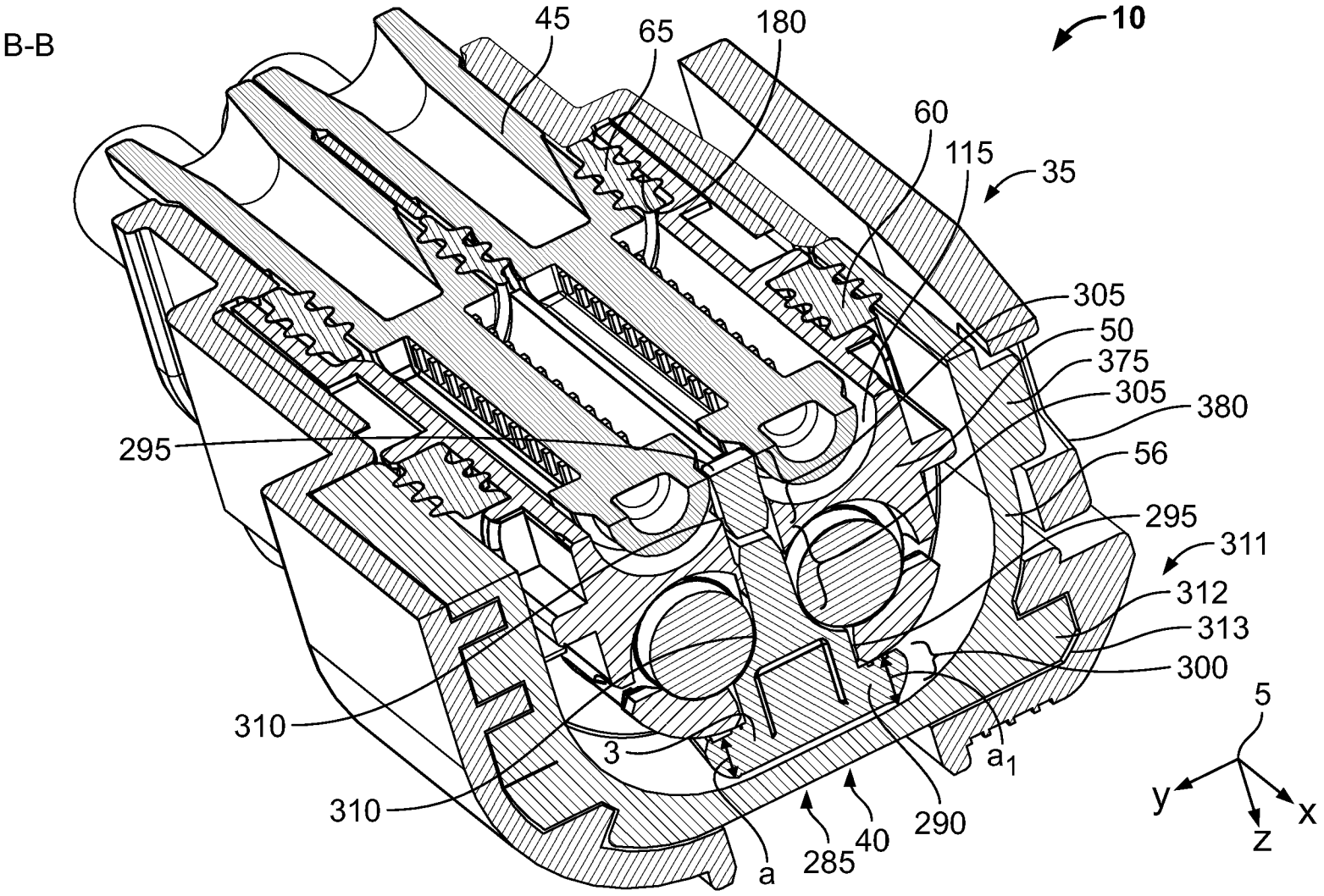
FIG. 6 is a sectional perspective view of the first portion of the contact system, taken along plane B-B of FIG. 4.

The first contact securing device 285 comprises a first pin 290 and a first recess 295, as shown in FIG. 6. Furthermore, a peripherally circumferential, groove-shaped second recess 310 is arranged on the outside of the securing section 120 of the first contact element 45. The first recess 295 is arranged in the inner housing 50. In the embodiment, a first contact securing device 285 is provided respectively for each xy-plane with first contact elements 45. Through the two respective xy-planes, which are arranged offset in the z-direction with the first contact elements 45, the first contact device 35 respectively has two first contact securing device 285, which are arranged opposite each other in the z-direction.

The first pin 290, as shown in FIG. 6, has a first holding section 300 and a first engaging section 305. The first holding section 300 is formed wider than the first recess 295 and the first engaging section 305 in the transverse direction. The first engaging section 305 is formed corresponding at least in sections to the first recess 295 and the second recess 310. The second engaging section 330 is formed in this case such that the first engaging section 305 tapers from the first holding section 300 to a free end of the first engaging section 305. A section of an outer contour of the first engaging section 305 is, in this case, formed running on a circular path. The first engaging section 305 engages through both the first recess 295 and the second recess 310, and thus secures the first contact element 45 in the inner housing 50.

In an embodiment, the first pin 290 has a T-shaped configuration, so that the first engaging section 305 can engage in two contact elements 45, 345 arranged adjacently side-by-side in two different second inner space sections 115 and is simultaneously attached securely against tilting in the first recess 295. In an embodiment, the first holding section 300 is formed wider than the first recess 295 in the transverse direction, in order to prevent the first pin 290 from sliding into the first recess 295.

As shown in FIG. 6, a coding device 311 can be provided, the coding device 311 having a coding rail 312 extending in the longitudinal direction and a coding receptacle 313, the coding rail 312 being arranged by way of example on the outside of the outer housing 56 of the second contact device 40. The coding receptacle 313 is arranged by way of example on the inside of the outer housing 55 of the first contact device 35. The coding rail 312 is formed to engage in the coding receptacle 313 and to guide the outer housing 56 of the second contact device 40. The coding rail 312 and the coding receptacle 313 are arranged such that the second contact device 40 can only be incorporated into the first contact device 35 in a single position. This is guaranteed, for example, by a geometry of the coding rail 312 and the coding receptacle 313 or by an off-centre arrangement of the coding device 311 at the outer housing 55, 56.

The second contact device 40, shown in FIG. 7, is substantially formed as a variant of the first contact device 35 described in FIGS. 1-6. A second contact securing device 315 is provided instead of the first contact securing device 285 at the second contact device 40. Likewise, two second contact securing devices 315, which are arranged opposite each other in the z-direction, are each provided by way of example for securing the second contact elements 345. The second contact securing device 315 is arranged between the inner housing 50 of the first contact device 35 and the inner housing 51 of the second contact device 40 in the longitudinal direction.

In order to avoid an unintentional release of the second contact device 40 from the first contact device 35, the contact system 10 additionally has a latching device 365, shown in FIG. 7. The latching device 365 has a latching clamp 370, which is provided at the outer housing 55 of the first contact device 35, and a latching lug 375, which is provided at the outer housing 56 of the second contact device 40, the latching lug 375 engaging in a latching receptacle 380 of the latching clamp 370 in the assembled state, in order to prevent an unintentional release of the second contact device 40 from the first contact device 35.

As shown in FIG. 8, the second contact securing device 315 is formed similarly to the first contact securing device 285 and has a second pin 327 with a second holding section 326, a second engaging section 330 and a third recess 335, as well as a fourth recess 320. The fourth recess 320 is jointly delimited by the inner housing 50 of the first contact device 35 and the inner housing 51 of the second contact device 40. The second engaging section 330 is connected to the second holding section 326. The second holding section 326 is arranged on the outside of the second engaging section 330. The second engaging section 330 is arranged abutting against the third recess 335 in the longitudinal direction.

As shown in FIG. 7, at the securing section 120, the second contact element 345 has a collar 340 which delimits the second recess 310 at the second contact element 345. The collar 340 is arranged at a free end of the securing section 120 of the second contact element 345 and is formed circumferentially in the peripheral direction of the second contact element 345. The collar 340 of the securing section 120 engages in the third recess 335 of the second pin 327. The second engaging section 330 engages in the second recess 310 of the second contact element 345 and in the fourth recess 320.

The second contact securing device 315 is connected to the inner housing 51 of the second contact device 40 by a latching connection 385, as shown in FIG. 8. The latching connection 385 has a spring section 390 which is attached to the inside of the inner housing 51 of the second contact device 40 at a fixed end. The spring section 390 extends in a yz-plane. Two spring sections 390, which are arranged opposite each other, are provided in a common yz-plane, wherein the second pin 327 is arranged between the spring sections 390.

The spring section 390 has a plurality of fifth recesses 395 on a side which faces the second pin 327. The second contact securing device 315 has a further latching lug 405 at a fourth side surface 400 of the second holding section 326. The further latching lug 405 is formed corresponding to the fifth recess 395. For assembly, the second contact securing device 315 is pressed in between the spring sections 390 in the transverse direction laterally from the outside, such that the second engaging section 330 engages in the second recess 310 and the fourth recess 320. Furthermore, the first engaging section 305 engages in the third recess 335. Moreover, the further latching lug 405 latches in the fifth recess 395 and secures the second pin 327 in the fourth recess 320.

With the second contact securing device 315, a predefined distance between the first inner housing 50 of the first contact device 35 and the inner housing 51 of the second contact device 40 can also be fixed and a position of the second contact element 345 in the inner housing 51 of the second contact device 40 can simultaneously be fixed.

The contact system 10 is particularly compact and reliably seals the first inner space 80 and the second inner space 105 from the environment 245 of the contact system 10. In this way, the reliable prevention of corrosion of the contact element 45, 345 in the region of the electrical contact is guaranteed. Furthermore, as a result of this, the reliability and long durability of the contact system 10 are guaranteed.

With the offset arrangement of the sealing elements 60, 65 in connection with the guide device 250, upon insertion of the second contact device 40 into the first contact device 35, the tilting of the outer housing 56 of the second contact device 40 in relation to the first contact device 35 is avoided. Therefore, damage to the sealing element 60, 65 or crushing of the sealing element 60, 65 by the outer housing 56 of the second contact device 40 is, where applicable, reliably avoided and thus any possible leakage from the inner space 80, 105. A reliable multiple inserting and releasing and a reliable impermeability of the contact system 10 are also guaranteed by the offset arrangement of the sealing element 60, 65.

The first contact device 35 and the second contact device 40 can be easily assembled. The first contact device 35 is assembled by the outer housing 55 being slid over the first electrical conductor 15 in a first method step.

In a second assembly step, the sealing elements 60, 65 are inserted into the respectively associated sealing receptacles 140, 175 of the inner housing 50 of the first contact device 35.

Subsequently, in a third assembly step, the first contact element 45 is inserted into the respectively associated second inner space section 115.

In a fourth assembly step, the first contact securing device 285 is assembled in that the first pin 290 is introduced into the first recess 295, until the first holding section 300 rests on the outside of the inner housing 50 of the first contact device 35 and the first engaging section 305 engages in the second recess 310 of the first contact element 45. As a result, the position in the longitudinal direction of the first contact element 45 relative to the inner housing 50 of the first contact device 35 is reliably fixed. In an embodiment, upon insertion of the first pin 290 into the first recess 295, the first pin 290 is clamped in the first recess 295.

In a fifth assembly step, the outer housing 55 of the first contact device 35 is slid over the inner housing 50 of the first contact device 35, until the first housing section 145 of the inner housing 50 of the first contact device 35 engages in the receptacle 220 of the outer housing 55 of the first contact device 35 and the bearing surfaces 265, 270 are tensioned by the tensioning device 275.

An unwanted release of the first pin 290 from the first recess 295 can be reliably avoided by the outer housing 55 of the first contact device 35 being superimposed on the inner housing 50 of the first contact device 35. In this case, a width a in the vertical direction of the first holding section 300 corresponds substantially to a distance a1 between the inner housing 50 and the outer housing 56 of the second contact device 40.

The assembly of the second contact device 40 is carried out substantially identically to the assembly of the first contact device 35. In the fourth assembly step, it is not the first contact securing device 285, but the second contact securing device 315 as described in FIG. 8 which is assembled and latched.

During the overall assembly of the contact system 10, the housing engaging section 76 of the outer housing 56 of the second contact device 40 is inserted between the inner housing 50 of the first contact device 35 and the outer housing 55 of the first contact device 35, such that the first sealing element 60 rests on the inside of the housing engaging section 76 and seals off the first inner space 80. Furthermore, the contact elements 45, 345 engage each other and form an electrical contact.

What is claimed is:

1. A contact device, comprising:

an outer housing delimiting a first inner space;

an inner housing delimiting a second inner space and arranged in the first inner space, the outer housing has a first bearing surface and the inner housing has a second bearing surface;

a contact element arranged in the second inner space;

a first sealing element arranged between the inner housing and the outer housing, the first sealing element sealing the first inner space from an environment of the contact device;

a second sealing element arranged between the contact element and the inner housing, the second sealing element sealing the second inner space from the environment; and a tensioning device formed to press the first bearing surface and the second bearing surface against each other, the tensioning device is arranged on an outside of the inner housing and presses the second bearing surface against the first bearing surface.

2. The contact device of claim 1, wherein the inner housing has a first sealing receptacle at an outer peripheral surface, the first sealing element is arranged in the first sealing receptacle.

3. The contact device of claim 2, wherein the first sealing receptacle is open at a side which faced the outer housing and the outer housing is arranged on an outside of the first sealing receptacle.

4. The contact device of claim 3, wherein the inner housing has a first housing section and a second housing section, the first housing section abuts against the second housing section in a longitudinal direction and the first housing section is formed wider than the second housing section in a transverse direction.

5. The contact device of claim 4, wherein the inner housing has a first web and a second web arranged offset to the first housing section in the longitudinal direction, the first web and the second web are arranged at the second housing section.

6. The contact device of claim 5, wherein the first web has a first side surface at a first longitudinal side delimiting the first sealing receptacle and the second web has a second side surface at a second longitudinal side delimiting the first sealing receptacle.

7. The contact device of claim 1, further comprising a second sealing receptacle open at a side facing away from the outer housing, the second sealing element is arranged in the second sealing receptacle.

8. The contact device of claim 7, wherein the second sealing element has a notch, the contact element engages the notch.

9. The contact device of claim 8, wherein the second sealing receptacle is delimited in a longitudinal direction at a first longitudinal side by a first shoulder of the inner housing and at a second longitudinal side by a third side surface of the outer housing, the second sealing receptacle is delimited in a transverse direction by a first inner peripheral surface of the inner housing.

10. The contact device of claim 9, wherein the third side surface is arranged at a protrusion of the outer housing.

11. The contact device of claim 10, wherein the outer housing has a receptacle between the protrusion and a second inner peripheral surface of the outer housing, the inner housing engages in the receptacle.

12. The contact device of claim 1, wherein the outer housing has a third shoulder arranged between the first sealing element and the second sealing element in a longitudinal direction.

13. The contact device of claim 12, wherein the third shoulder has a stop surface arranged on a longitudinal side which faces the first sealing element, the stop surface is formed to define an end position of a further contact device relative to the contact device.

14. The contact device of claim 1, further comprising a contact securing device having a first recess arranged in the inner housing.

15. The contact device of claim 14, wherein the contact element has a securing section with a second recess, the second recess is arranged overlapping the first recess in a longitudinal direction.

16. The contact device of claim 15, wherein the contact securing device has a pin engaging in the first recess and the second recess and connecting the inner housing to the contact element in a form-fitting manner.

17. The contact device of claim 1, further comprising a contact securing device arranged in the first inner space, an end face of the contact securing device rests on the inner housing.

18. The contact device of claim 17, wherein the contact element has a securing section with a second recess and a collar, the collar delimits the second recess at a longitudinal side.

19. The contact device of claim 18, wherein the contact securing device has a third recess and a pin with an engaging section, the third recess and the engaging section abut against each other.

20. The contact device of claim 19, wherein the contact securing device has a fourth recess, the inner housing delimits the fourth recess in sections.

21. The contact device of claim 20, wherein the engaging section engages in the second recess and in the fourth recess, the collar engages in the third recess.

22. The contact device of claim 1, wherein the first bearing surface and the second bearing surface are arranged between the first sealing element and the second sealing element in a longitudinal direction.

23. The contact device of claim 22, wherein the tensioning device is formed as a thickening.

24. The contact device of claim 1, further comprising a guide device having a guide rail extending in a longitudinal direction and a guide receptacle extending in the longitudinal direction, the guide rail and the guide receptacle engage each other.

25. The contact device of claim 24, wherein the guide receptacle is arranged on an inside of the outer housing and the guide rail is arranged on an outside of the inner housing, and/or the guide receptacle is arranged on the outside of the inner housing and the guide rail is arranged on the inside of the outer housing.

26. The contact device of claim 1, further comprising a coding device having a coding rail extending in a longitudinal direction, the coding rail is arranged on an outside of the outer housing, the coding rail is formed to engage in a coding receptacle of a further contact device and guide the further contact device in the longitudinal direction.

27. The contact device of claim 1, further comprising a sealing plug having an identical outer contour to the contact element in sections, the sealing plug closes off the second inner space from the environment.

28. A contact system, comprising:

a first contact device including a first outer housing delimiting a first inner space, an inner housing delimiting a second inner space and arranged in the first inner space, the first outer housing has a first bearing surface and the inner housing has a second bearing surface, a contact element arranged in the second inner space, a first sealing element arranged between the inner housing and the first outer housing, the first sealing element sealing the first inner space from an environment of the contact device, a second sealing element arranged between the contact element and the inner housing, the second sealing element sealing the second inner space from the environment, and a tensioning device formed to press the first bearing surface and the second bearing surface against each other, the tensioning device is arranged on an outside of the inner housing and presses the second bearing surface against the first bearing surface; and a second contact device including a second outer housing delimiting the first inner space, the second outer housing has a housing engaging section engaging the first outer housing, the housing engaging section is arranged between the first sealing element and the first outer housing.

29. The contact system of claim 28, further comprising a contact securing device arranged between the inner housing of the first contact device and an inner housing of the second contact device, the contact securing device is formed to fix a predefined distance between the inner housing of the first contact device and the inner housing of the second contact device.

30. A contact device, comprising:

an outer housing delimiting a first inner space;

an inner housing delimiting a second inner space and arranged in the first inner space;

a contact element arranged in the second inner space, the contact element has a securing section with a second recess and a collar, the collar delimits the second recess at a longitudinal side;

a first sealing element arranged between the inner housing and the outer housing, the first sealing element sealing the first inner space from an environment of the contact device;

a second sealing element arranged between the contact element and the inner housing, the second sealing device sealing the second inner space from the environment; and a contact securing device arranged in the first inner space, an end face of the contact securing device rests on the inner housing.

31. The contact device of claim 30, wherein the contact securing device has a third recess and a pin with an engaging section, the third recess and the engaging section abut against each other.

32. The contact device of claim 31, wherein the contact securing device has a fourth recess, the inner housing delimits the fourth recess in sections.

33. The contact device of claim 32, wherein the engaging section engages in the second recess and in the fourth recess, the collar engages in the third recess.

* * * * *